US010781673B2

(12) United States Patent
Kim et al.

(10) Patent No.: US 10,781,673 B2
(45) Date of Patent: Sep. 22, 2020

(54) BASE PIPES FOR SAND CONTROL SCREEN ASSEMBLIES

(71) Applicant: Chevron U.S.A. Inc., San Ramon, CA (US)

(72) Inventors: Namhyo Kim, Houston, TX (US); Antonio Lazo, Houston, TX (US); Elaine Lange, Bellaire, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 18 days.

(21) Appl. No.: 16/219,417

(22) Filed: Dec. 13, 2018

(65) Prior Publication Data

US 2019/0120027 A1 Apr. 25, 2019

Related U.S. Application Data

(62) Division of application No. 15/353,013, filed on Nov. 16, 2016, now Pat. No. 10,184,323.

(60) Provisional application No. 62/403,887, filed on Oct. 4, 2016, provisional application No. 62/350,394, filed on Jun. 15, 2016.

(51) Int. Cl.
*E21B 43/10* (2006.01)
*E21B 43/08* (2006.01)

(52) U.S. Cl.
CPC ..... *E21B 43/086* (2013.01); *E21B 43/08* (2013.01); *E21B 43/082* (2013.01); *E21B 43/088* (2013.01); *E21B 43/10* (2013.01)

(58) Field of Classification Search
CPC ..... E21B 43/10; E21B 43/082; E21B 43/086; E21B 43/088; E21B 43/08
See application file for complete search history.

(56) References Cited

U.S. PATENT DOCUMENTS 975,334 A 11/1910 Decker et al.
1,273,236 A 7/1918 Layne
1,878,432 A 9/1932 Whann
(Continued)

FOREIGN PATENT DOCUMENTS

CN 105257250 1/2016
JP 2007126888 5/2007
WO 2017039840 3/2017

OTHER PUBLICATIONS

International Search Report issued for International Patent Application No. PCT/US2016/041972 dated Oct. 11, 2016, 3 pages.

*Primary Examiner* — Cathleen R Hutchins
(74) *Attorney, Agent, or Firm* — King & Spalding LLP

(57) ABSTRACT

A sand control screen assembly includes a base pipe having multiple first openings through a thickness of the base pipe, where at least one of the first openings is characterized by a non-uniform cross-section, where each first opening has a first portion and a second portion adjacent to the first portion, where the first portion is disposed adjacent to an inner surface of the base pipe, where the second portion is disposed adjacent to an outer surface of the base pipe, where the second portion includes multiple channels, where each channel extends outward and upward relative to the first portion, where each channel includes a wall having a side wall edge and a base wall edge, where an interface surface between the side wall edge and the base wall edge is a planar surface.

19 Claims, 16 Drawing Sheets

(56) References Cited

U.S. PATENT DOCUMENTS

| | | | | |
|---|---|---|---|---|
| 3,177,945 | A * | 4/1965 | Fether | B01D 29/33 166/227 |
| 5,339,895 | A | 8/1994 | Arterbury et al. | |
| 5,355,956 | A * | 10/1994 | Restarick | E21B 43/11 166/296 |
| 5,957,205 | A | 9/1999 | Bohme et al. | |
| 2008/0289815 | A1 | 11/2008 | Moen et al. | |
| 2011/0105477 | A1 | 5/2011 | Hammer | |
| 2011/0192613 | A1 * | 8/2011 | Garcia | E21B 23/08 166/373 |
| 2014/0238657 | A1 * | 8/2014 | Sladic | E21B 41/0078 166/51 |

* cited by examiner

Section A-A'

BASE PIPES FOR SAND CONTROL SCREEN ASSEMBLIES

CROSS-REFERENCE TO RELATED APPLICATIONS

This application is a divisional application of and claims the benefit of U.S. patent application Ser. No. 15/353,013, titled "Base Pipes For Sand Control Screen Assemblies" and filed on Nov. 16, 2016, which claims priority under 35 U.S.C. § 119 to U.S. Provisional Patent Application Ser. No. 62/350,394, titled "Base Pipes For Sand Control Screen Assemblies" and filed on Jun. 15, 2016, and to U.S. Provisional Patent Application Ser. No. 62/403,887, titled "Base Pipes For Sand Control Screen Assemblies" and filed on Oct. 4, 2016. The entire contents of these aforementioned applications are hereby incorporated herein by reference.

TECHNICAL FIELD

The present application relates generally to structures adapted for filtering particulates from a flowing fluid in a wellbore that traverse a subterranean hydrocarbon bearing formation, and in particular, to base pipes for sand control screen assemblies.

BACKGROUND

Sand exclusion screen assemblies are employed in wellbores during the production of hydrocarbon fluids from subterranean formations. Conventional sand screen assemblies include a perforated base pipe, a drainage layer, a filter medium, and a protective jacket or shroud. Such screen assemblies are designed to filter out particles, such as formation sand or placed gravel/proppant, while facilitating the passage of hydrocarbon fluids into the wellbore. One drawback in the deployment of such screen assemblies is the erosion of the filter medium by particle impingement contained in the fluids that pass the screen assemblies. The presence of particulate in the flow stream, coupled with the current designs and manufacturing methods of the screen assemblies, can cause erosion. For instance, current designs and manufacturing methods minimize the space, or offset, between the sand screen components for a number of reasons, which can increase erosion of the filter medium. Also, current base pipe designs have a limited inflow area due to limited number of perforated holes. These holes cause a flow concentration that localizes and increases the erosion of the filter medium. When the filter medium becomes eroded, then particles are produced from the well, which is highly undesirable. Production of these particles can cause excessive erosion of production tubulars, downhole equipment and surface equipment, and lead to high maintenance costs and undesirable downtime of wells.

Accordingly, a need has arisen for a sand control screen assembly that is capable of filtering fines out of a production stream from a subterranean hydrocarbon bearing formation and that does not readily suffer from erosion.

SUMMARY

The present application is generally related to base pipes for sand control screen assemblies for filtering particulates from a flowing fluid in a wellbore that traverses a subterranean hydrocarbon bearing formation.

In an example embodiment, a sand control screen assembly includes a base pipe having one or more openings through a thickness of the pipe. The openings are characterized by a non-uniform cross-section. In certain instances, the openings are characterized by an inner portion and an outer portion, whereby the inner and outer portions vary in dimensions. Generally, a drainage layer is positioned about the base pipe, a filter medium is positioned about the drainage layer, and a protective shroud is positioned about the filter medium. In certain instances where a drainage layer is not utilized, a filter medium is positioned about the base pipe, and a protective shroud is positioned about the filter medium.

In another example embodiment, a sand control screen assembly includes a base pipe having an outer surface and an inner surface. The base pipe includes one or more openings extending from the outer surface to the inner surface through a thickness of the base pipe. The base pipe also includes one or more channels or grooves positioned on the outer surface and in flow communication with at least one of the openings.

These and other aspects, objects, features, and embodiments will be apparent from the following description and the appended claims.

DETAILED DESCRIPTION

Figure 1:
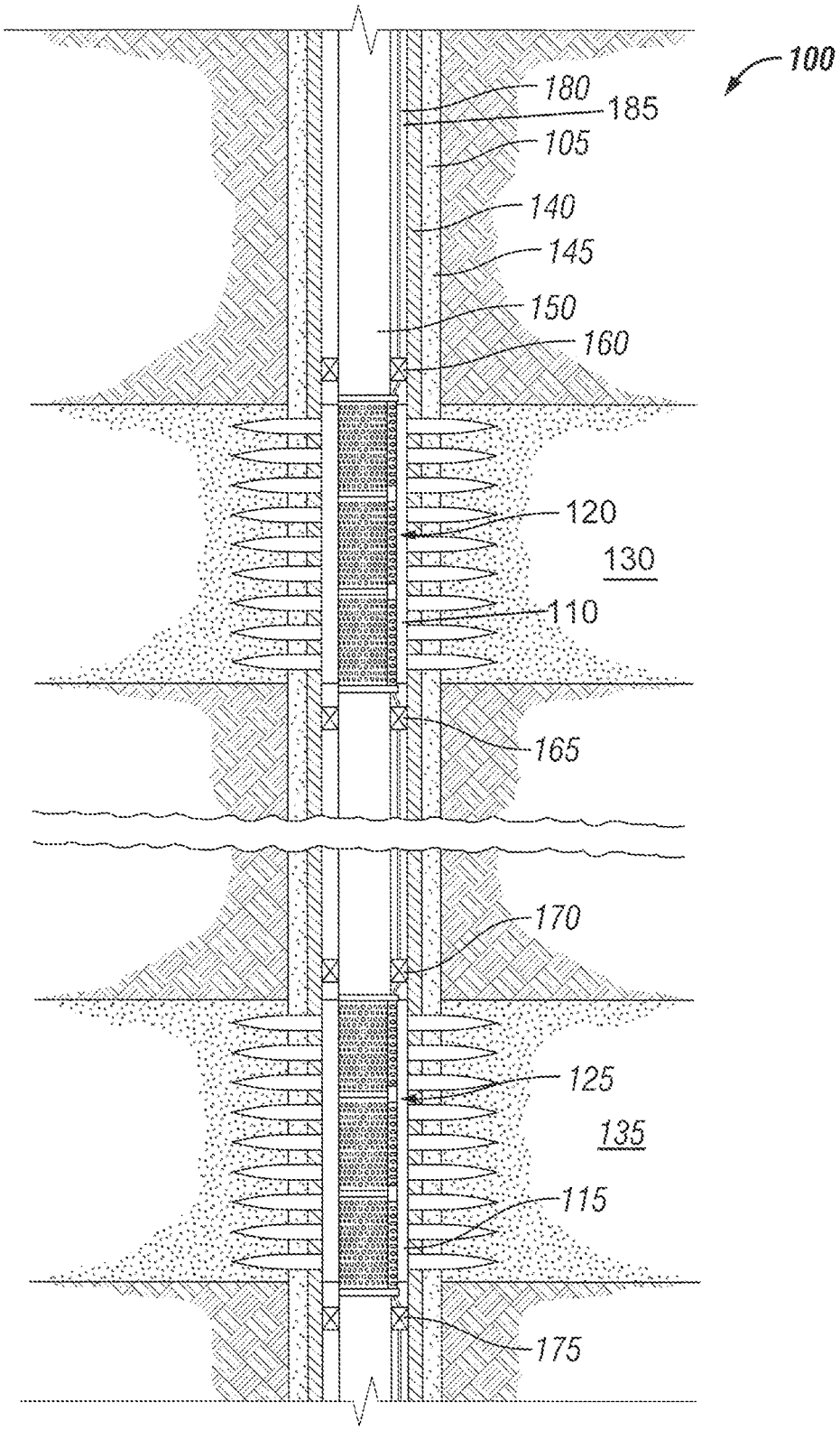
FIG. 1 is a schematic illustration of a wellbore environment including a pair of sand control screen assemblies, according to an embodiment of the present invention.

The present application provides sand control screen assemblies that are more resistant to erosion than conventional sand control screen assemblies. By limiting erosion loss, it is not required to reduce the rate of oil and gas production, which is common in instances of sand screen erosion.

The invention may be better understood by reading the following description of non-limitative, exemplary embodiments with reference to the attached drawings, wherein like parts of each of the figures are identified by the same reference characters. In the following description of the representative embodiments of the invention, directional terms, such as "above", "below", "upper", "lower", "top", "bottom", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore towards the bottom of well.

Referring to FIG. 1, illustrated is a wellbore system 100 that may employ the principles of the present disclosure, according to one or more embodiments of the disclosure. As depicted, the wellbore system 100 includes a wellbore 105 having production intervals 110, 115, having sand control screen assemblies 120, 125, respectively, positioned therein. The wellbore 105 extends through various formations 130, 135 in the earth strata. A casing 140 is supported within wellbore 105 by cement 145. A production or completion string 150 includes various tools, such as sand control screen assembly 120 that is positioned within production interval 110 between packers 160, 165. In addition, the production or completion string 150 includes a sand control screen assembly 125 that is positioned within production interval 115 between packers 170, 175. The sand control screen assemblies 120, 125 serve the primary functions of filtering particulate matter out of the production fluid stream and may also include flow control capabilities or other additional functionality. One or more control lines 180 may extend from a ground surface within annulus 185 and pass through sand control screen assemblies 120, 125 to provide instructions, carry power, signals and data, and transport operating fluid, such as hydraulic fluid, to sensors, actuators and the like associated with sand control screen assemblies 120, 125 and other tools or components positioned downhole. Sensors (not shown) operably associated with production or completion string 150 may be used to provide valuable information to the operator via control line 180 during the production phase of the well, such as fluid temperature, pressure, velocity, constituent composition and the like, such that the operator can enhance the production operations.

Even though FIG. 1 depicts sand control screen assemblies 120, 125 in a cased hole environment, one skilled in the art will recognize that the sand control screen assemblies of the present invention are equally well suited for use in open hole environments. Also, even though FIG. 1 depicts a vertical completion, one skilled in the art will recognize that the sand control screen assemblies of the present invention are equally well suited for use in well having other directional configurations including horizontal wells, deviated wells, multilateral wells, and the like.

FIGS. 2A-2D illustrate an exemplary embodiment of a sand control screen assembly 200 for use in wellbore 105 (FIG. 1). FIG. 2E is a partial perspective view of a base pipe 205 of screen assembly 200. FIG. 2F is a partial top view of the base pipe 205 showing spacer ribs 235*a* of a drainage layer 210 thereon, according to an embodiment of the present invention. Along with the other sand control screen assemblies described in the present application, the sand control screen assembly 200 may replace one or more of the screen assemblies 120, 125 described in FIG. 1 and may otherwise be used in the exemplary wellbore system 100 depicted therein.

The screen assembly 200 generally includes a perforated base pipe 205, a drainage layer 210, a filter medium 215, and a protective jacket or shroud 220. Generally, during hydrocarbon production, fluid from the subterranean formation flows in a direction from the formation, through the shroud 220, and towards a central axis Ac of the base pipe 205. The base pipe 205 provides structural support to the assembly 200, and also provides flow communication via openings 225 with the production or completion string 150 (FIG. 1) in the wellbore 105. The drainage layer 210 occasionally is a slotted screen 230 and includes a plurality of ribs 235*a* that are substantially symmetrically disposed or positioned about the central axis Ac of the base pipe 205. In certain embodiments, the slotted screen 230 is made up of wrapped wires. The drainage layer 210 is placed around the surface of the base pipe 205 and typically distributes inflow to the base pipe 205. The filter medium 215 that surrounds the drainage layer 210 is utilized for particle control and/or particle filtration of a predetermined size. The filter medium 215 is generally woven, wire-wrapped, or slotted liner. The shroud 220 surrounds the filter medium 215 and provides protection to the assembly 200 during installation. In certain exemplary embodiments, the shroud 220 is a slotted screen jacket. In alternative embodiments, the shroud 220 may be a wire-wrapped jacket, a perforated jacket, or a stamped jacket. In certain exemplary embodiments, the shroud 220 includes a plurality of ribs 235*b* that are substantially symmetrically disposed or positioned about the central axis Ac of the base pipe 205. In certain embodiments, the drainage layer 210, composed of the slotted screen 230 and the plurality of ribs 235*a*, can be replaced by other porous structures such as metal meshes. Furthermore, in certain alternative embodiments, the screen assemblies consist of only a drainage layer and a filter medium, without a protective jacket or shroud, wherein the wrapped wires function as the filter medium and the plurality of ribs provides a drainage layer.

The base pipe 205 is a generally cylindrical-shaped tube 240 having one or more openings 225 that extend from an outer wall 240*a* of the tube 240 to an inner wall 240*b* of the tube 240. In certain cases, fluid from the subterranean formation flows in a direction from the outer wall 240*a* towards the inner wall 240*b* through openings 225. In certain exemplary embodiments, the openings 225 have a non-uniform cross-section. In certain exemplary embodiments, the openings 225 include an outer or top portion 245 and an inner or bottom portion 250. The top portion 245 may be larger in size than the bottom portion 250 in a perspective top planar view. In other words, the openings 225 are counterbore holes. For instance, the top portion 245 may have a circular profile having a diameter D1 when viewed from the top, and the bottom portion 250 may have a circular profile having a diameter D2 when viewed from the top, where the diameter D1 is larger than the diameter D2. In certain exemplary embodiments, the diametric ratio D2/D1 may in a range of from about 0.05 to about 0.95. One having ordinary skill in the art will recognize that in alternative embodiments, the planar top view profile of the top portion 245 of the opening 225 can have any shape configuration, such as triangular, circular, elliptical, oval, square, quatrefoil, curvilinear triangular, rectangular, trapezoidal, pentagon, hexagon, other polygons, asymmetrical, and the like. One having ordinary skill in the art will also recognize that the non-uniform cross-section shaped openings 225 can be intermittently placed on the base pipe 205 (e.g. the base pipe 205 may contain some uniform cross-section shaped openings as well).

Figure 2A:
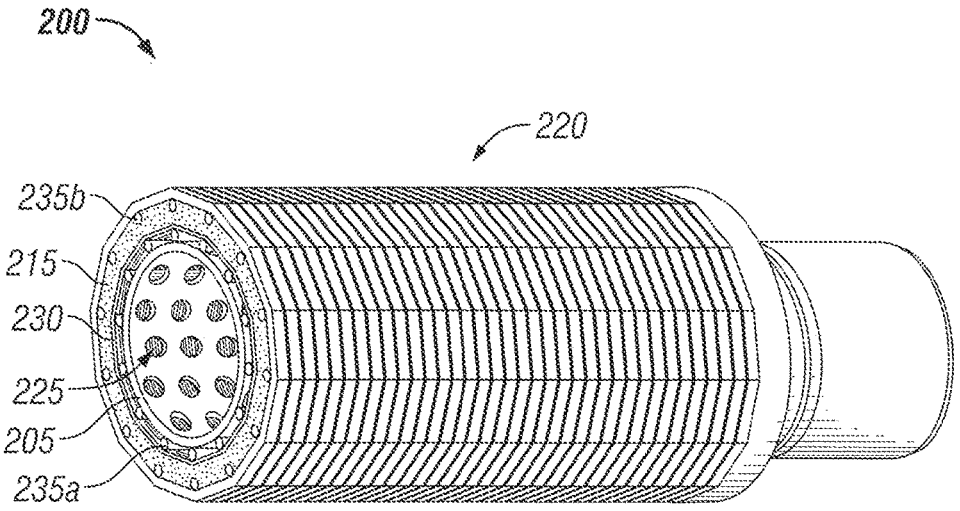
FIG. 2A is a top perspective view of a sand control screen assembly, according to an embodiment of the present invention.
Figure 2B:
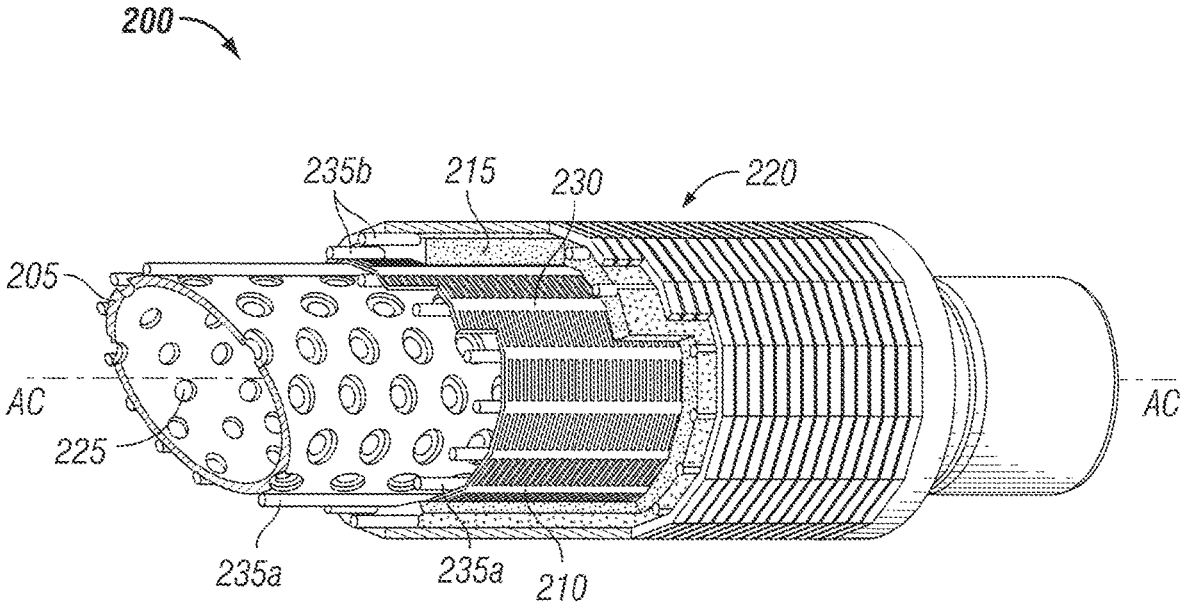
FIG. 2B is a partial cut away view of the sand control screen assembly of FIG. 2A, according to an embodiment of the present invention.
Figure 2C:
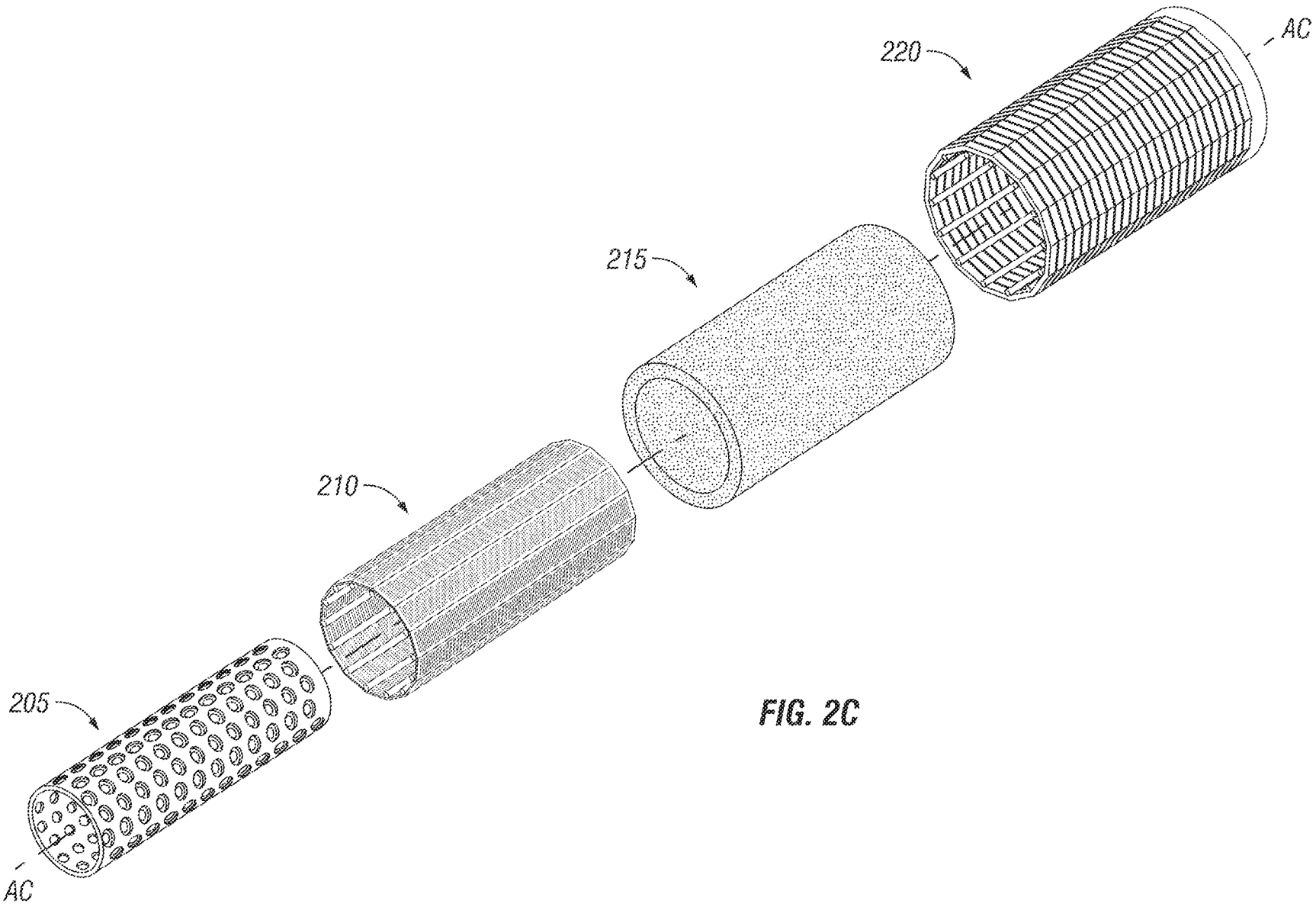
FIG. 2C is an exploded view of the sand control screen assembly of FIG. 2A, according to an embodiment of the present invention.
Figure 2D:
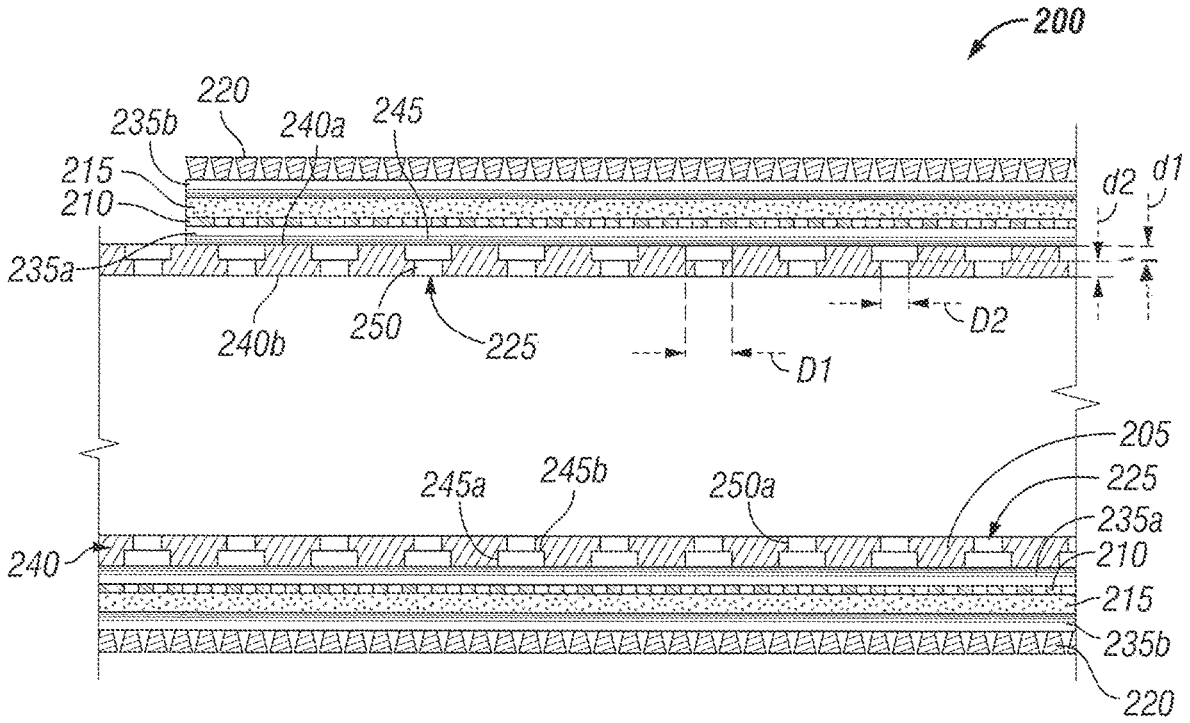
FIG. 2D is a side cross-sectional view of the sand control screen assembly of FIG. 2A, according to an embodiment of the present invention.
Figure 2E:
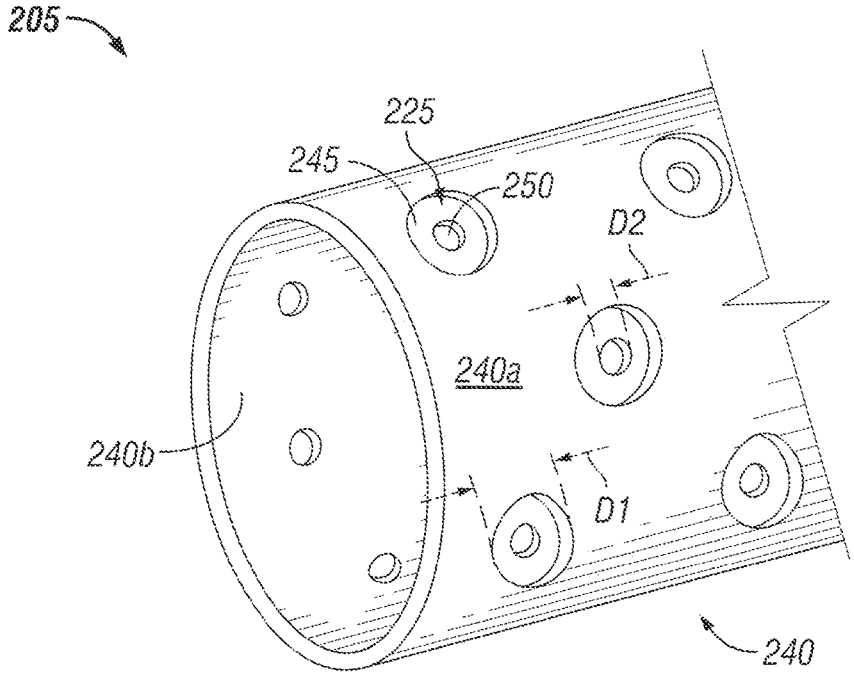
FIG. 2E is a partial perspective view of a base pipe of the sand control screen assembly of FIG. 2A, according to an embodiment of the present invention.
Figure 2F:
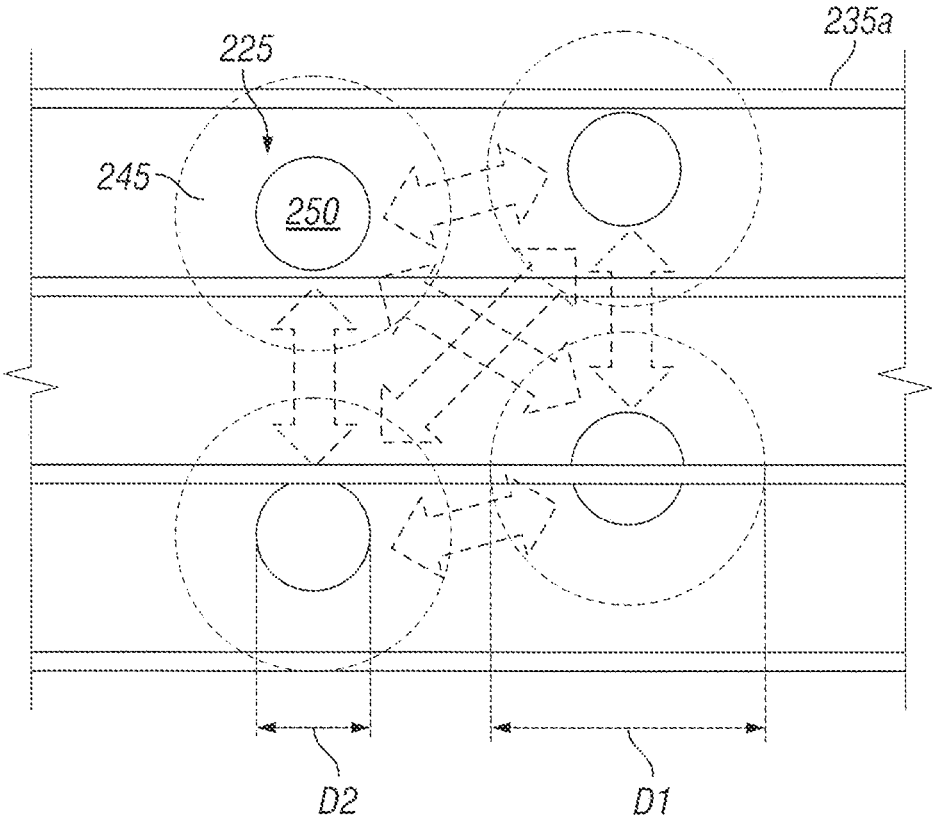
FIG. 2F is a top view of a base pipe for a sand control screen assembly of FIG. 2A showing spacer ribs (of a drainage layer) thereon, according to an embodiment of the present invention.

As shown in FIG. 2D, the side cross-sectional profile shows that the top portion 245 of the opening 225 has a side wall 245*a* that is generally perpendicular to a base wall 245*b*. In certain exemplary embodiments, the side wall 245*a* of the top portion 245 of opening 225 has a depth d1 that is less than a depth d2 of a side wall 250*a* the bottom portion 250 of opening 225. In other words, the top portion 245 may be shallower than the bottom portion 250. In certain exemplary embodiments, the depth ratio d1/d2 may be in a range of from about 0.05 to about 0.95. In exemplary embodiments, and as shown in FIG. 2F, the larger diameter D1 of the top portion 245 of the openings 225 of the base pipe 205 provides additional surface area for fluid flow over conventional base pipes where flow may be more limited or otherwise stagnant due to the position of ribs 235*a* of the drainage layer 210 over the openings. Accordingly, the larger diameter D1 of the top portion 245 of the openings 225 of the base pipe 205 allows for a decrease in flow velocity and particle inertia because of the funneling effect of varying cross-section area. In certain exemplary embodiments, the top portion 245 of the openings 225 may cover at least two proximate rib channels so that flow communication can occur between the channels. In other words, fluid flow is not concentrated to a single sized opening as in conventional base pipes, but rather, there is reduced influx of flow towards the base pipe of the present invention due to enlarged sizing of the top portion of the opening enhancing flow communication between adjacent openings (illustrated by arrows in FIG. 2F).

Figure 3A:
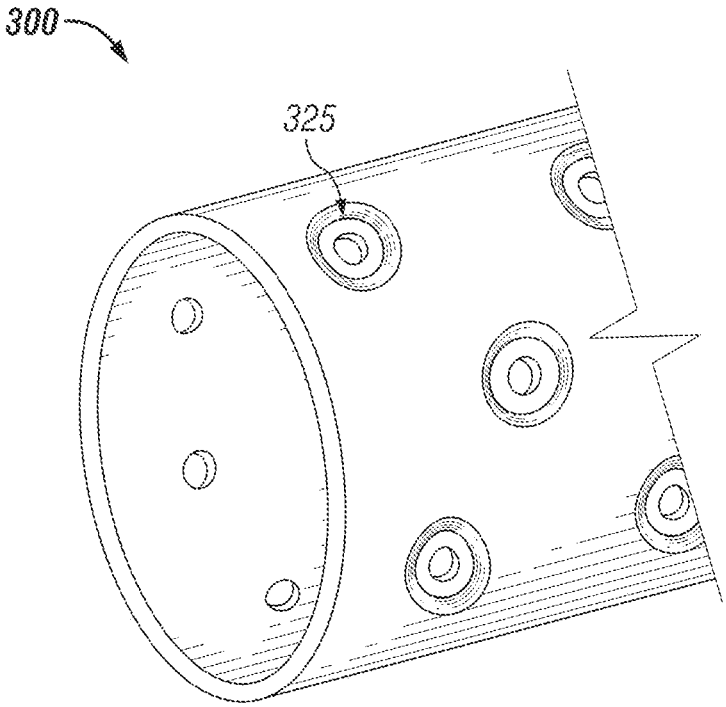
FIG. 3A is a top perspective view of a base pipe for a sand control screen assembly, according to an embodiment of the present invention.
Figure 3B:
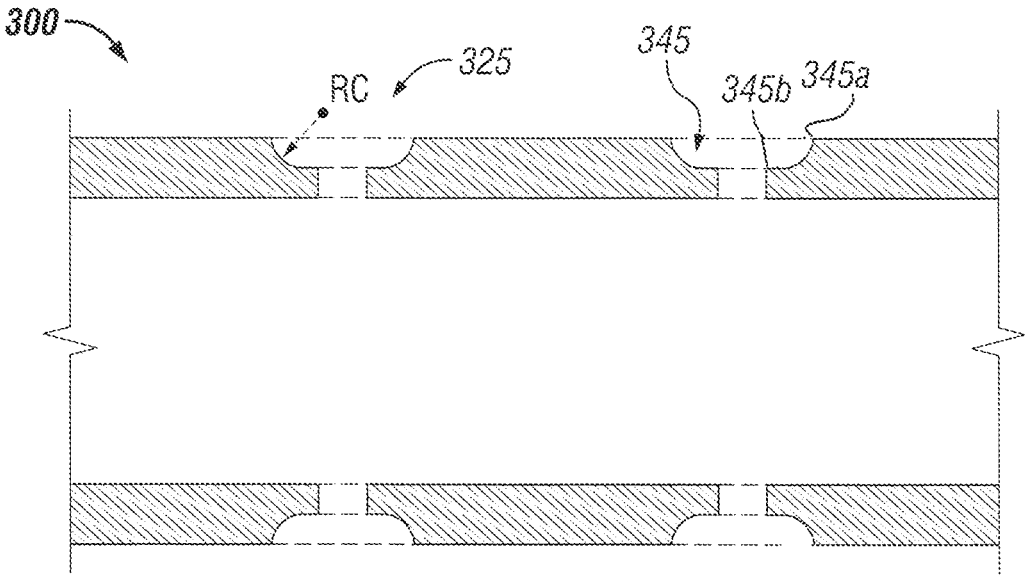
FIG. 3B is a side cross-sectional view of the base pipe of FIG. 3A, according to an embodiment of the present invention.

FIGS. 3A-3B illustrate an exemplary embodiment of a base pipe 300 for a sand control screen assembly for use in a wellbore. Along with the other base pipes described in the present application, the base pipe 300 may replace the base pipe 205 of the sand control screen assembly 200 described in FIGS. 2A-2D and may otherwise be used in the exemplary wellbore system 100 (FIG. 1) depicted therein. The base pipe 300 is the same as that described above with regard to base pipe 205, except as specifically stated below. For the sake of brevity, the similarities will not be repeated herein below.

The base pipe 300 includes one or more openings 325. As shown in FIG. 3B, the side cross-sectional profile shows that an outer or top portion 345 of opening 325 has a side wall edge 345*a* and a base wall edge 345*b*. As shown in FIG. 3B, the interface surface between the wall edge 345*a* and the wall edge 345*b* is a generally curved or arced surface having a radius of curvature RC. In certain alternative embodiments, the interface between the wall edge 345*a* and the wall edge 345*b* is a straight planar surface. Furthermore, the interface surface between the wall edge 345*a* and the wall edge 345*b* can be a single surface as described above, or segmented into multiple surfaces with different configurations as described below.

Figure 4A:
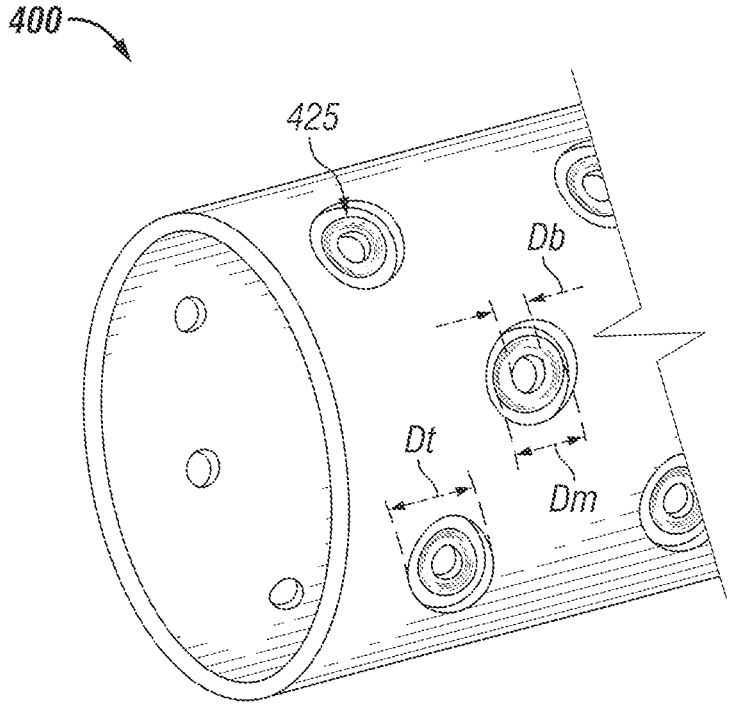
FIG. 4A is a top perspective view of a base pipe for a sand control screen assembly, according to an embodiment of the present invention.
Figure 4B:
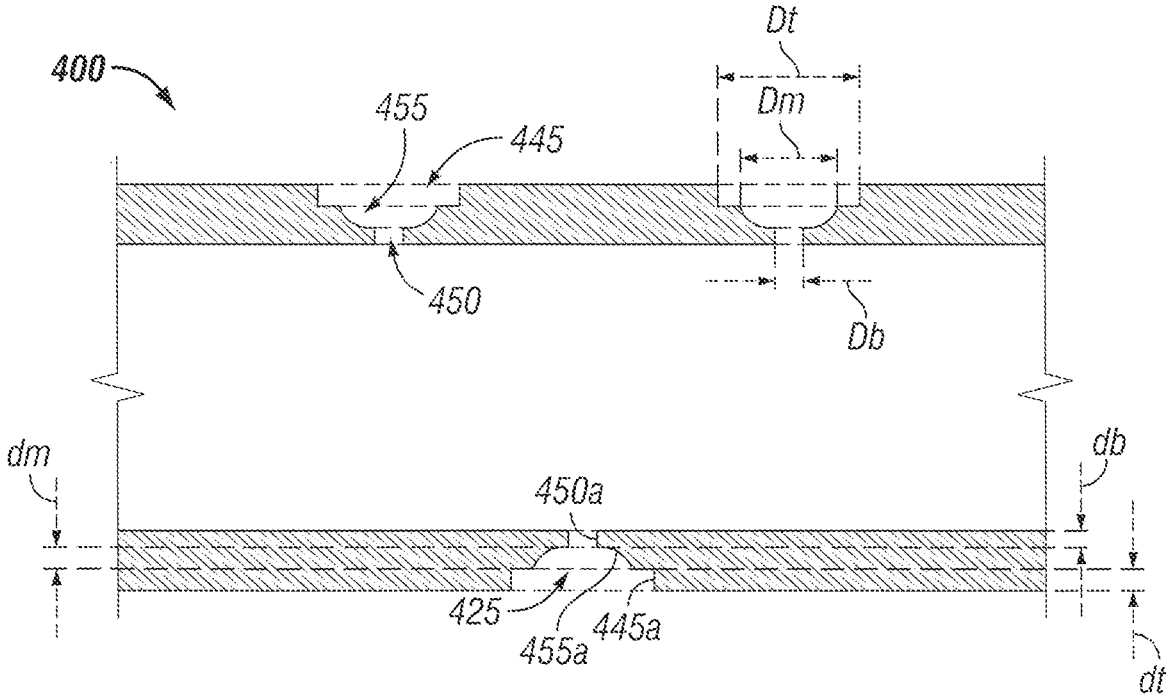
FIG. 4B is a side cross-sectional view of the base pipe of FIG. 4A, according to an embodiment of the present invention.

FIGS. 4A-4B illustrate an exemplary embodiment of a base pipe 400 for a sand control screen assembly for use in a wellbore. Along with the other base pipes described in the present application, the base pipe 400 may replace the base pipe 205 of the sand control screen assembly 200 described in FIGS. 2A-2D and may otherwise be used in the exemplary wellbore system 100 (FIG. 1) depicted therein. The base pipe 400 is the same as that described above with regard to base pipe 205, except as specifically stated below. For the sake of brevity, the similarities will not be repeated hereinbelow.

Referring now to FIG. 4A-4B, the base pipe 400 includes one or more openings 425 having an outer or top portion 445, a middle portion 455, and an inner or bottom portion 450. In certain exemplary embodiments, the planar top view profile of top portion 445 is generally similar to the top portion 245 of opening 225 (FIGS. 2A-2D), the planar top view profile of middle portion 455 is generally similar to the top portion 345 of opening 325 (FIGS. 3A-3B), and the planar top view profile of bottom portion 450 is generally similar to the bottom portion 250 of opening 225 (FIGS. 2A-2D). One having ordinary skill in the art will recognize that in alternative embodiments, the planar top view profile of top portion 445 could be generally similar to the top portion 345 of opening 325, and the profile of middle portion 455 could be generally similar to the top portion 245 of opening 225. One having ordinary skill in the art will also recognize that in alternative embodiments, the planar top view profiles of both the top portion 445 and middle portion 455 could be generally similar and have any shape, but vary in size. One having ordinary skill in the art will also recognize that in alternative embodiments, the planar top view profiles of the top portion 445 and middle portion 455 could have different shapes, and vary in size.

In exemplary embodiments, the top portion 445 may be larger in size than the middle portion 455, and the middle portion 455 may be larger in size than the bottom portion 450. For instance, the top portion 445 may have a circular profile having a diameter Dt when viewed from the top, the middle portion 455 may have a circular profile having a diameter Dm when viewed from the top, and the bottom portion 250 may have a circular profile having a diameter Db when viewed from the top, where the diameter Dt is larger than the diameter Dm, and where the diameter Dm is larger than the diameter Db. In certain exemplary embodiments, the diametric ratio Dm/Dt may be in a range of from about 0.05 to about 0.95. In certain embodiments, the diametric ratio Db/Dm may be in a range of from 0.05 to about 0.95.

As shown in FIG. 4B, in certain exemplary embodiments, a side wall 445*a* of the top portion 445 of opening 425 has a depth dt, a side wall 455*a* of the middle portion 455 of opening 425 has a depth dm, and a side wall 450*a* of the bottom portion 450 of opening 425 has a depth db. In certain embodiments, the depth dt may be less than the depth db. In certain embodiments, the depth dm may be less than the depth db. In certain embodiments, the depth dt may be greater than the depth dm. In certain other embodiments, the depth dt may be less than the depth dm. In yet other embodiments, the depth dt may be the same as the depth dm. One having ordinary skill in the art will recognize that the size and configuration of the top portion 445, the middle portion 455, and the bottom portion 450 of the opening 425 may vary from application to application, and be based on fluid flow needs or manufacturing capabilities.

Figure 5A:
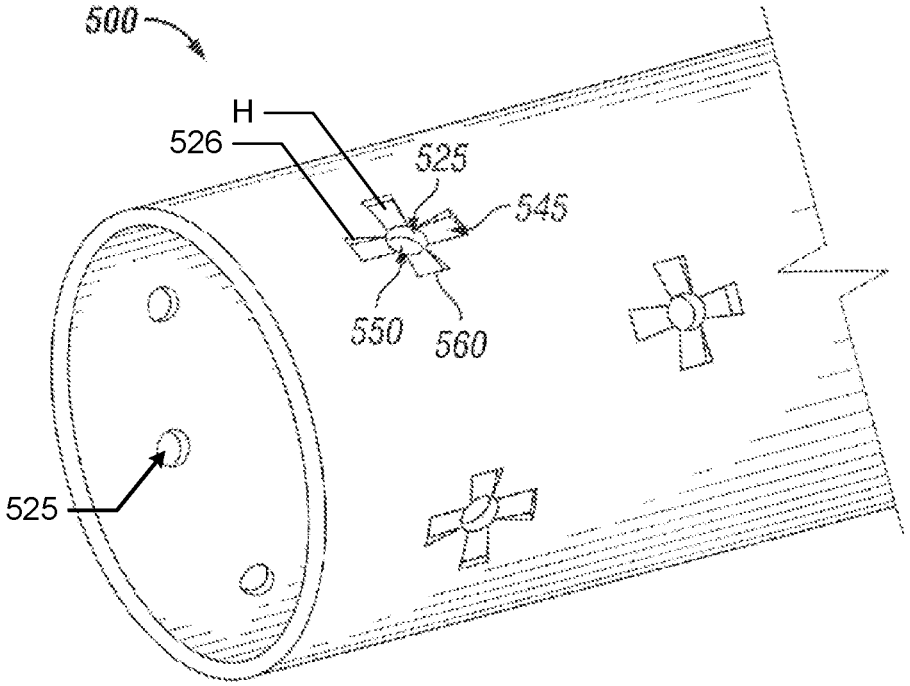
FIG. 5A is a top perspective view of a base pipe for a sand control screen assembly, according to an embodiment of the present invention.
Figure 5B:
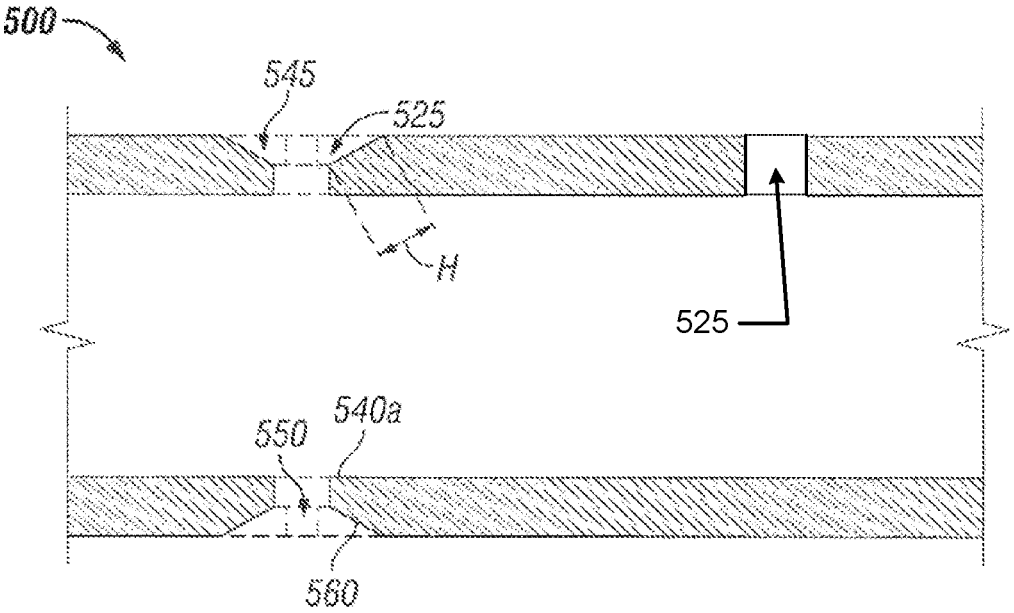
FIG. 5B is a side cross-sectional view of the base pipe of FIG. 5A, according to an embodiment of the present invention.

FIGS. 5A-5B illustrate an exemplary embodiment of a base pipe 500 for a sand control screen assembly for use in a wellbore. Along with the other base pipes described in the present application, the base pipe 500 may replace the base pipe 205 of the sand control screen assembly 200 described in FIGS. 2A-2D and may otherwise be used in the exemplary wellbore system 100 (FIG. 1) depicted therein. The base pipe 500 is the same as that described above with regard to base pipe 205, except as specifically stated below. For the sake of brevity, the similarities will not be repeated hereinbelow.

Referring now to FIG. 5A-5B, the base pipe 500 includes one or more openings 525. As shown in FIG. 5A, the planar top view profile shows that an outer or top portion 545 of opening 525 includes a plurality of channels or grooves 560 extending radially outward from an inner or bottom portion 550 of the opening 525. As shown in FIG. 5B, the grooves 560 may have a side cross-sectional profile shaped like a right triangle, where the hypotenuse H extends from an outer wall 540*a* of the base pipe 500 to the bottom portion 550 of the opening 525. Each groove 560 in this case also forms side walls 526 that define the sides of the groove 560. One having ordinary skill in the art will recognize that in alternative embodiments, the side cross-sectional profile of the grooves 560 of the opening 525 can have any shape configuration, such as curved or arced, square, rectangular, trapezoidal, other polygons, asymmetrical, and the like. One having ordinary skill in the art will recognize that while the present embodiment includes four grooves 560, in alternative embodiments, the number of grooves 560 present can vary from base pipe to base pipe, or vary even within a single base pipe. One having ordinary skill in the art will also recognize that there can be grooves 560 on every opening 525. In alternative embodiments, not every opening 525 will include grooves. For instance, in certain embodiments, every other opening will include the grooves. As another example, as shown in FIGS. 5A and 5B, the array of openings 525 without a top portion 545 and openings 525 with top portions 545 can be randomly arranged. In addition, the present embodiment illustrates that some of the openings 525 include a top portion 545 having a noncircular or discontinuous cross-section.

Figure 6:
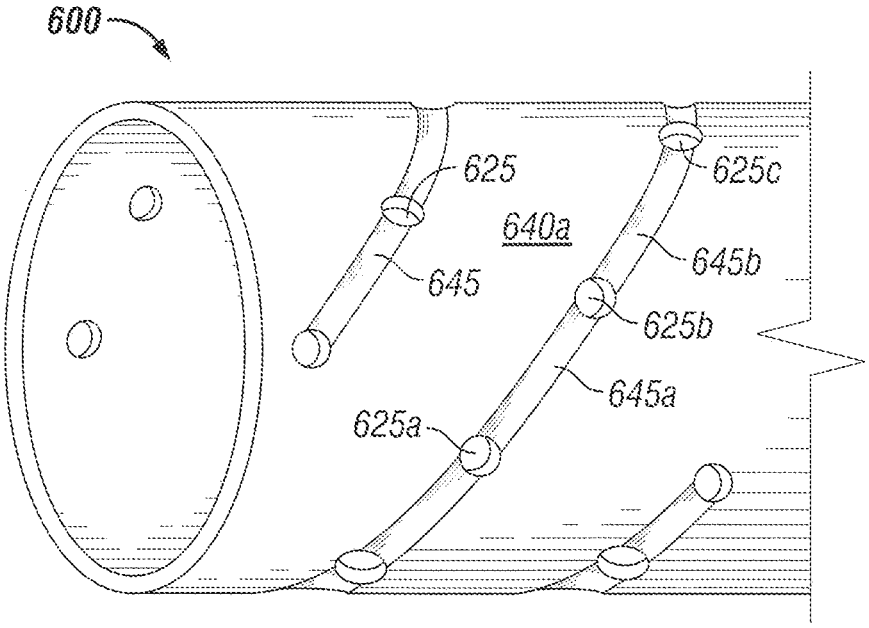
FIG. 6 is a top perspective view of a base pipe for a sand control screen assembly, according to an embodiment of the present invention.

FIG. 6 illustrates an exemplary embodiment of a base pipe 600 for a sand control screen assembly for use in a wellbore. Along with the other base pipes described in the present application, the base pipe 600 may replace the base pipe 205 of the sand control screen assembly 200 described in FIGS. 2A-2D and may otherwise be used in the exemplary wellbore system 100 (FIG. 1) depicted therein. The base pipe 600 is the same as that described above with regard to base pipe 205, except as specifically stated below. For the sake of brevity, the similarities will not be repeated hereinbelow.

The base pipe 600 includes one or more openings 625 in flow communication via channels or grooves 645. For instance, grooves 645*a*, 645*b* extend from and connect adjacent openings 625*a*, 625*b*, 625*c* that are positioned helically on the base pipe 600. The grooves 645 are set within outer wall 640*a*, and do not traverse the thickness of the base pipe 600. The width of the grooves 645 can be wide enough to include the width of the diameter of the openings 625. The presence of helical grooves between openings 625 provides enhanced extra flow paths in occasional cases that the drainage layer 210 (FIGS. 2A-2D) restricts the flow distribution between base pipe openings 225 (FIGS. 2A-2E). For instance, the restricted flow distributions between the openings 225 may take place by the drainage layer 210 that is narrow in height from the base pipe outer surface, or by the presence of ribs 235*a* (FIGS. 2A-2D) that block the circumferential flow distribution between the openings 225. One having ordinary skill in the art will recognize that the openings 625 may be in flow communication with grooves 645 in any configuration, such as circumferentially, longitudinally, spirally, helically, and combinations thereof. One having ordinary skill in the art will also recognize that not all openings will be in flow communication with an adjacent opening.

Figure 7:
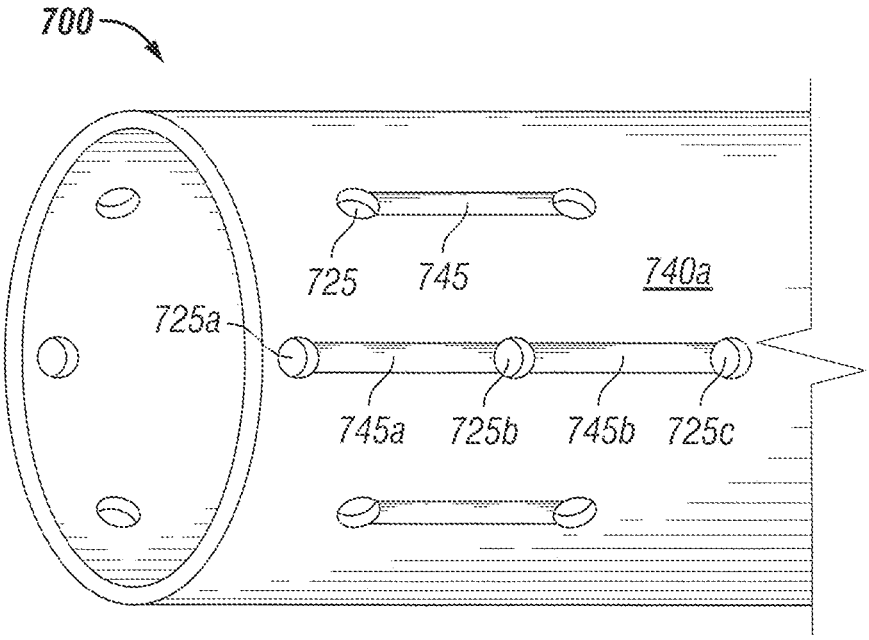
FIG. 7 is a top perspective view of a base pipe for a sand control screen assembly, according to an embodiment of the present invention.

FIG. 7 illustrates an exemplary embodiment of a base pipe 700 for a sand control screen assembly for use in a wellbore. Along with the other base pipes described in the present application, the base pipe 700 may replace the base pipe 205 of the sand control screen assembly 200 described in FIGS. 2A-2D and may otherwise be used in the exemplary wellbore system 100 (FIG. 1) depicted therein. The base pipe 700 is the same as that described above with regard to base pipe 600, except as specifically stated below. For the sake of brevity, the similarities will not be repeated hereinbelow.

The base pipe 700 includes one or more openings 725 in flow communication via channels or grooves 745. For instance, grooves 745*a*, 745*b* extend from and connect adjacent openings 725*a*, 725*b*, 725*c* that are positioned longitudinally on the base pipe 700. In other words, grooves 745 are disposed on an outer surface or wall 740*a* along a length of the base pipe 700. The grooves 745 are set within outer surface or wall 740*a*, and do not traverse the thickness of the base pipe 700.

Figure 8:
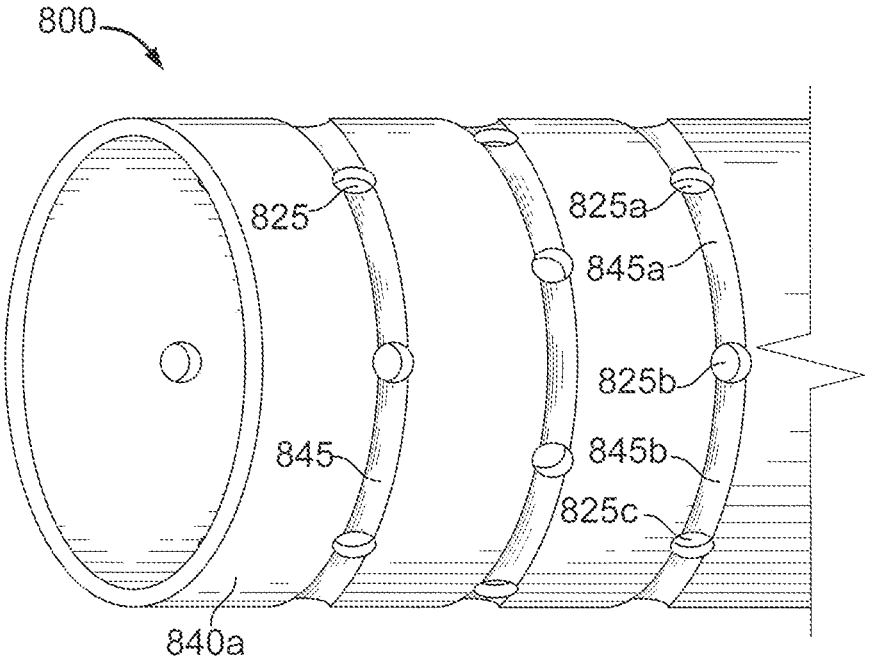
FIG. 8 is a top perspective view of a base pipe for a sand control screen assembly, according to an embodiment of the present invention.

FIG. 8 illustrates an exemplary embodiment of a base pipe 800 for a sand control screen assembly for use in a wellbore. Along with the other base pipes described in the present application, the base pipe 800 may replace the base pipe 205 of the sand control screen assembly 200 described in FIGS. 2A-2D and may otherwise be used in the exemplary wellbore system 100 (FIG. 1) depicted therein. The base pipe 800 is the same as that described above with regard to base pipe 600, except as specifically stated below. For the sake of brevity, the similarities will not be repeated hereinbelow.

The base pipe 800 includes one or more openings 825 in flow communication via channels or grooves 845. For instance, grooves 845*a*, 845*b* extend from and connect adjacent openings 825*a*, 825*b*, 825*c* that are positioned circumferentially on the base pipe 800. The grooves 845 are set within outer wall 840*a*, and do not traverse the thickness of the base pipe 800.

Figure 9A:
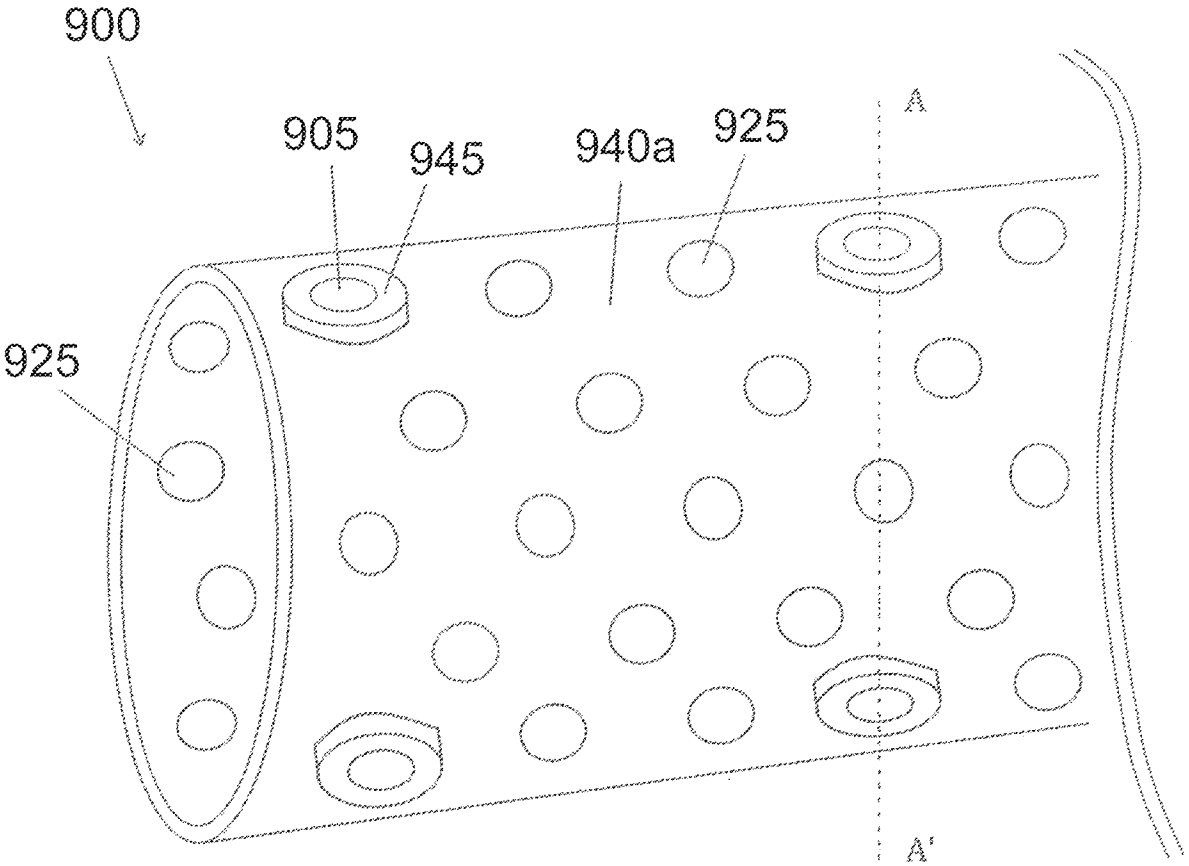
FIG. 9A is a top perspective view of a base pipe for a sand control screen assembly, according to an embodiment of the present invention.
Figure 9B:
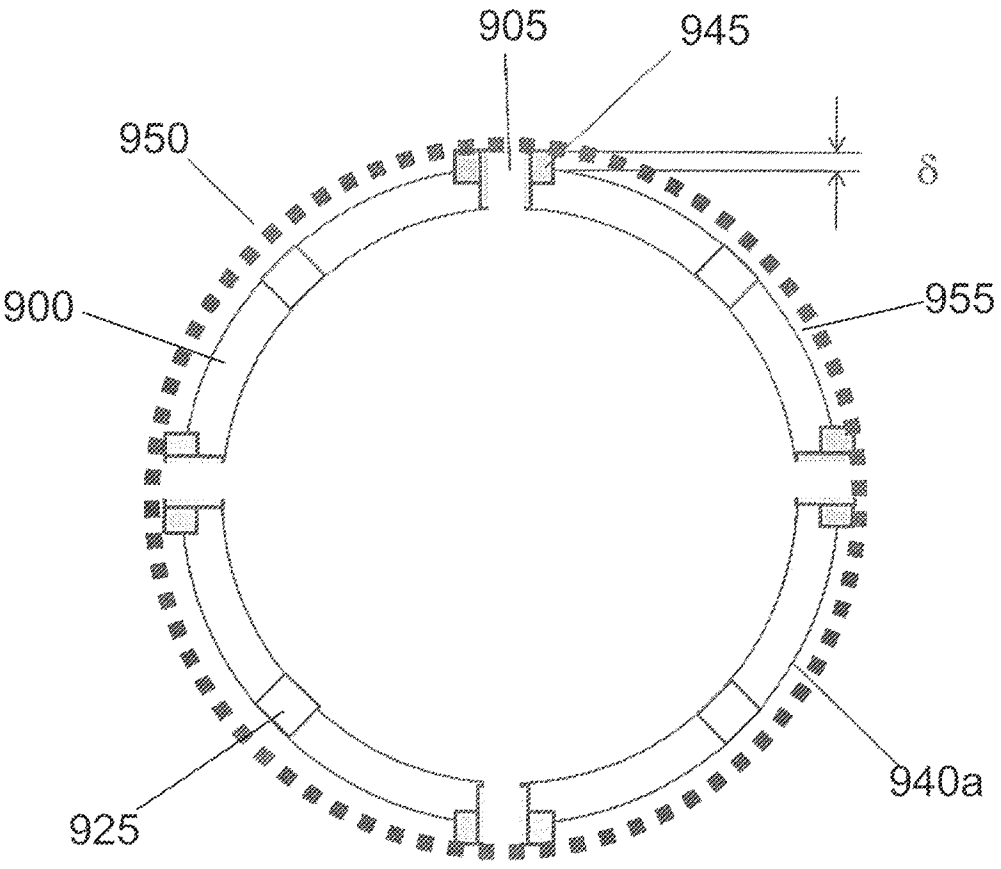
FIG. 9B is a side cross-sectional view of the base pipe of FIG. 9A, according to an embodiment of the present invention.

FIGS. 9A-9B illustrate an exemplary embodiment of a base pipe 900 for a sand control screen assembly for use in a wellbore. Along with the other base pipes described in the present application, the base pipe 900 may replace the base pipe 205 of the sand control screen assembly 200 described in FIGS. 2A-2D and may otherwise be used in the exemplary wellbore system 100 (FIG. 1) depicted therein.

The base pipe 900 includes one or more openings 925, some of which having an insert 945 positioned therein on the side proximate an outer wall 940*a* of the base pipe 900. The inserts 945 may include an internal opening 905 that allows for flow communication directly from the exterior of filter medium or supportive structure 950 (FIG. 9B) towards the interior of the base pipe 900. Referring to FIG. 9B, the inserts 945 essentially provide an offset δ such that when a filter medium or supportive structure 950 is positioned about the base pipe 900, the additional offset δ forms a widely open channel 955 between the base pipe outer surface 940*a* and the filter medium or supportive structure 950, and therefore results in unhindered flow distribution between openings 925. The inserts 945 can be sectioned or slotted to allow for flow communication between the channel 955 and the interior of the base pipe 900. In certain exemplary embodiments, the offset δ may eliminate the need for a drainage layer (not shown) in a sand control screen assembly. While the present embodiment illustrates an insert having a circular shape in the planar top view, one having ordinary skill in the art will recognize that the inserts 945 may have any shape configuration that allows for flow communication to openings 925, and provide an offset δ from the outer wall 940*a*. For instance, the planar top view profile of the inserts 945 can have any shape configuration, such as triangular, floral, elliptical, oval, square, quatrefoil, curvilinear triangular, rectangular, trapezoidal, pentagon, hexagon, other polygons, asymmetrical, and the like.

The inserts 945 may be constructed from any material suitable for use with the screen assemblies of the present invention in a downhole environment, and may include erodible materials with tracers and/or fibers, the same material as the underlying base pipe 900, a high temperature erosion resistant material (such as cobalt based alloys and carbides), a coated or hardened material, plastics suitable for use as metal replacements, and the like.

Figure 10A:
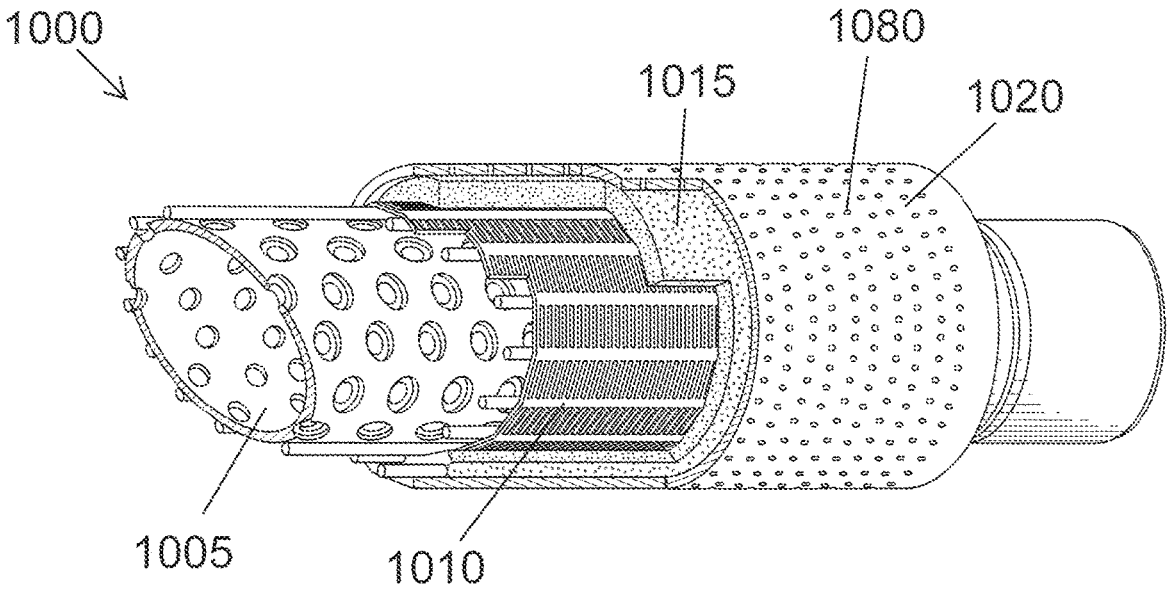
FIG. 10A is a partial cut away view of a sand control screen assembly, according to an embodiment of the present invention.
Figure 10B:
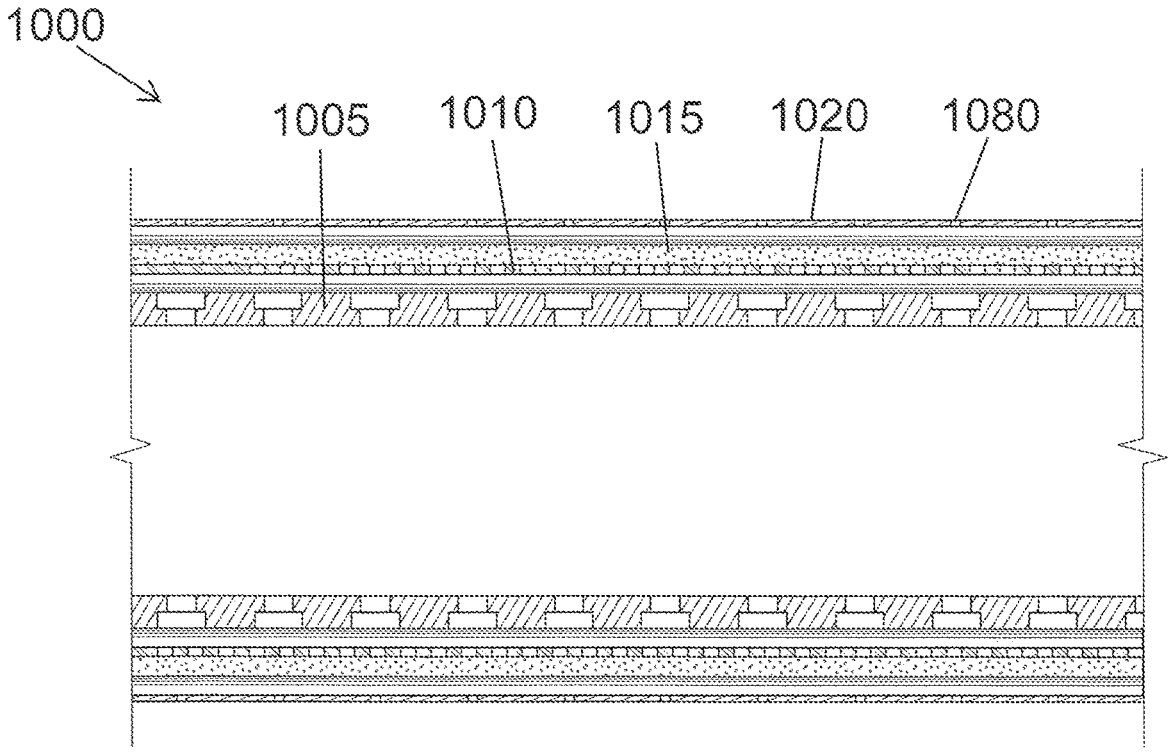
FIG. 10B is a side cross-sectional view of the sand control screen assembly of FIG. 10A, according to an embodiment of the present invention.

FIGS. 10A-10B illustrate an exemplary embodiment of a sand control screen assembly 1000 for use in wellbore 105 (FIG. 1). Along with the other sand control screen assemblies described in the present application, the sand control screen assembly 1000 may replace one or more of the screen assemblies 120, 125 described in FIG. 1 and may otherwise be used in the exemplary wellbore system 100 depicted therein. The screen assembly 1000 is the same as that described above with regard to screen assembly 200, except as specifically stated below. For the sake of brevity, the similarities will not be repeated hereinbelow.

The screen assembly 1000 includes a perforated base pipe 1005 (similar to base pipe 205), a drainage layer 1010 (similar to drainage layer 210), a filter medium 1015, and a protective jacket or shroud 1020. The filter medium 1015 that surrounds the drainage layer 210 is generally a metal mesh. In certain embodiments, the filter medium 1015 may or may not contain ribs. The shroud 1020 surrounds the filter medium 1015 and provides protection to the screen assembly 1000 during installation. In certain exemplary embodiments, the shroud 1020 is a perforated jacket having a plurality of openings 1080.

Figure 11A:
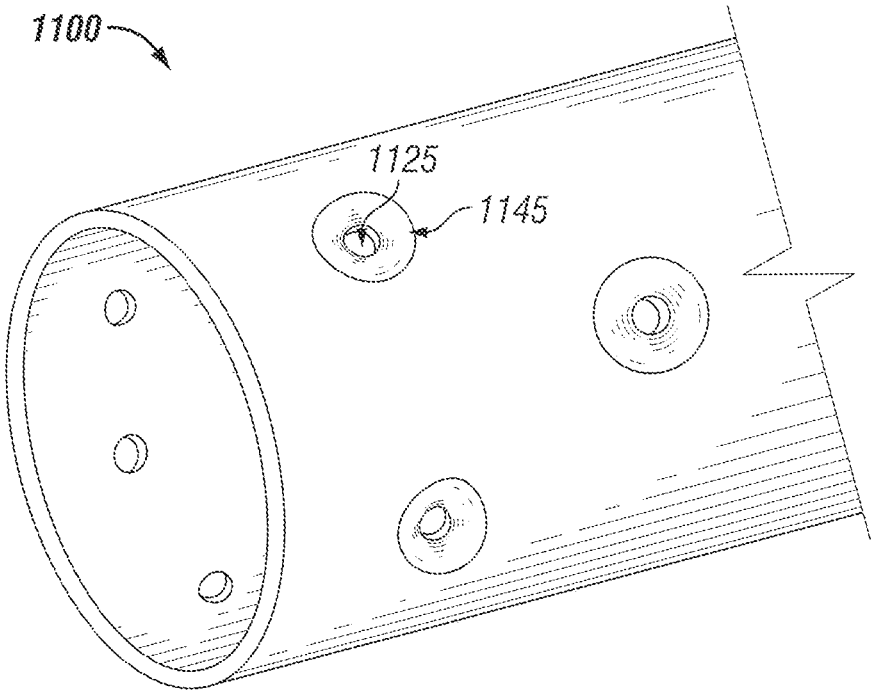
FIG. 11A is a top perspective view of a base pipe for a sand control screen assembly, according to an embodiment of the present invention.
Figure 11B:
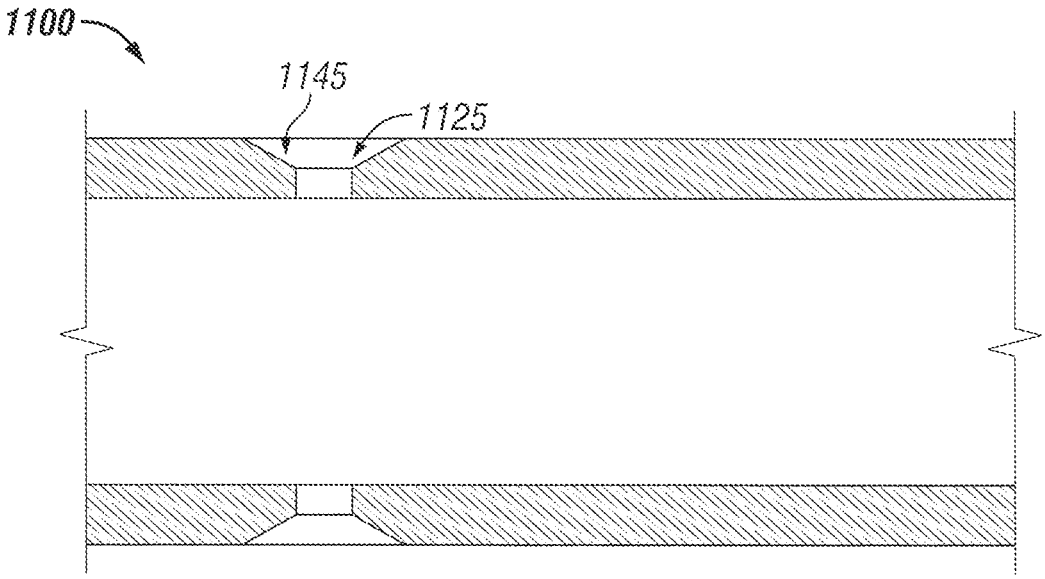
FIG. 11B is a side cross-sectional view of the base pipe of FIG. 11A, according to an embodiment of the present invention.

FIGS. 11A-11B illustrate an exemplary embodiment of a base pipe 1100 for a sand control screen assembly for use in a wellbore. Along with the other base pipes described in the present application, the base pipe 1100 may replace the base pipe 205 of the sand control screen assembly 200 described in FIGS. 2A-2D and may otherwise be used in the exemplary wellbore system 100 (FIG. 1) depicted therein. The base pipe 1100 is the same as that described above with regard to base pipe 205, except as specifically stated below. For the sake of brevity, the similarities will not be repeated herein below. The base pipe 1100 includes one or more openings 1125 having an upper portion 1145. As shown in FIG. 11B, the side cross-sectional profile shows that the opening 1125 is countersunk, or the upper portion 1145 is beveled.

Figure 12A:
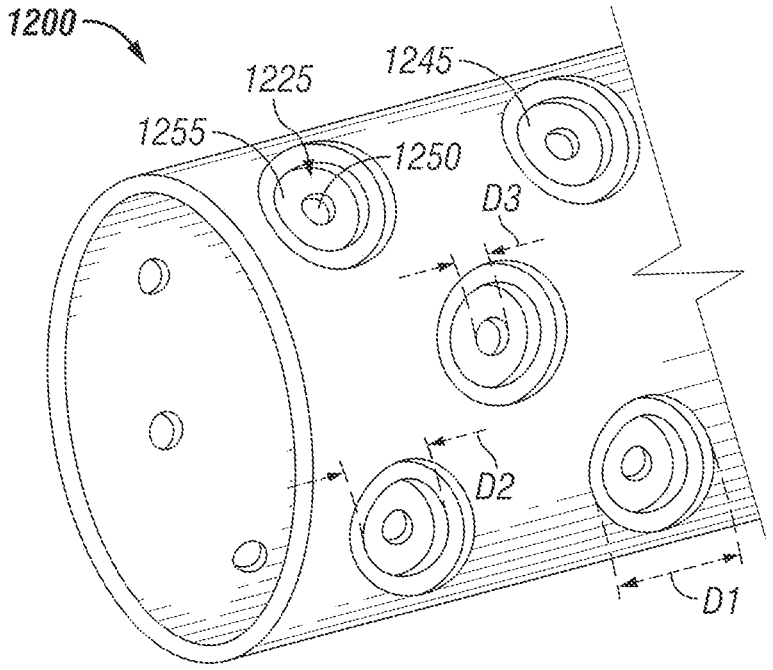
FIG. 12A is a top perspective view of a base pipe for a sand control screen assembly, according to an embodiment of the present invention.
Figure 12B:
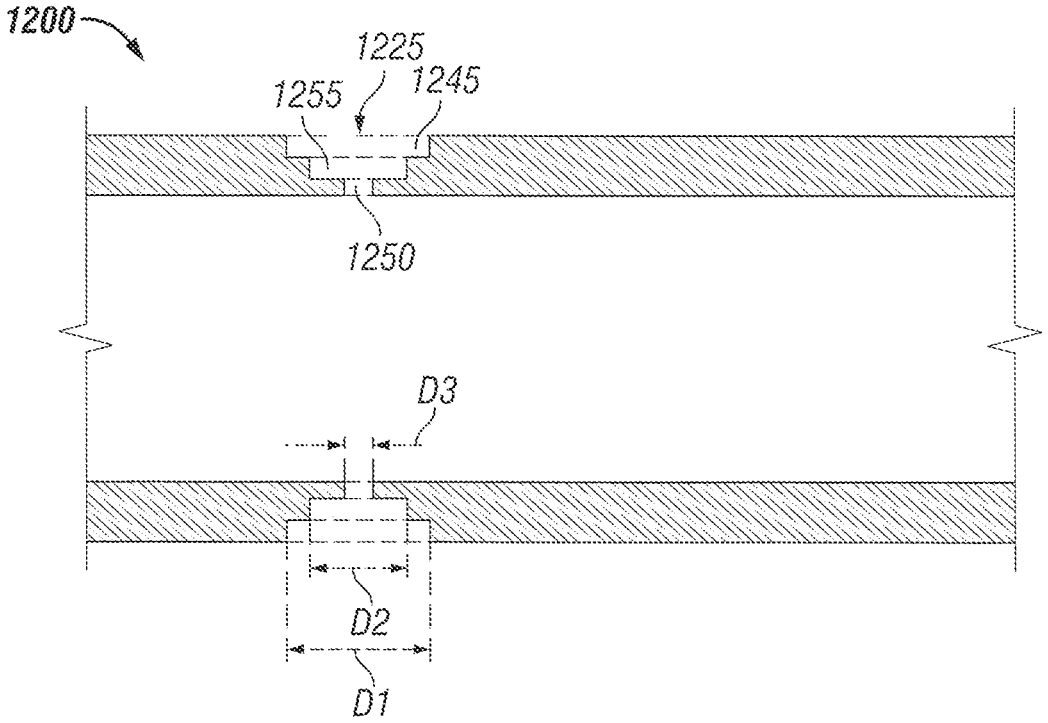
FIG. 12B is a side cross-sectional view of the base pipe of FIG. 12A, according to an embodiment of the present invention.

FIGS. 12A-12B illustrates an exemplary embodiment of a base pipe 1200 for a sand control screen assembly for use in a wellbore. Along with the other base pipes described in the present application, the base pipe 1200 may replace the base pipe 205 of the sand control screen assembly 200 described in FIGS. 2A-2D and may otherwise be used in the exemplary wellbore system 100 (FIG. 1) depicted therein. The base pipe 1200 is the same as that described above with regard to base pipe 205, except as specifically stated below. For the sake of brevity, the similarities will not be repeated herein below.

The base pipe 1200 includes one or more openings 1225 having an outer or top portion 1245, a middle portion 1255, and an inner or bottom portion 1250. The top portion 1245 may be larger in size than the middle portion 1255, and the middle portion 1255 may be larger in size than the bottom portion 1250 in a perspective top planar view. In other words, the openings 1225 are multi-counterbore holes. For instance, the top portion 1245 may have a circular profile having a diameter D1 when viewed from the top, the middle portion 1255 may have a circular profile having a diameter D2 when viewed from the top, and the bottom portion 1250 may have a circular profile having a diameter D3 when viewed from the top, where the diameter D1 is larger than the diameter D2, and the diameter D2 is larger than the diameter D3.

Figure 13:
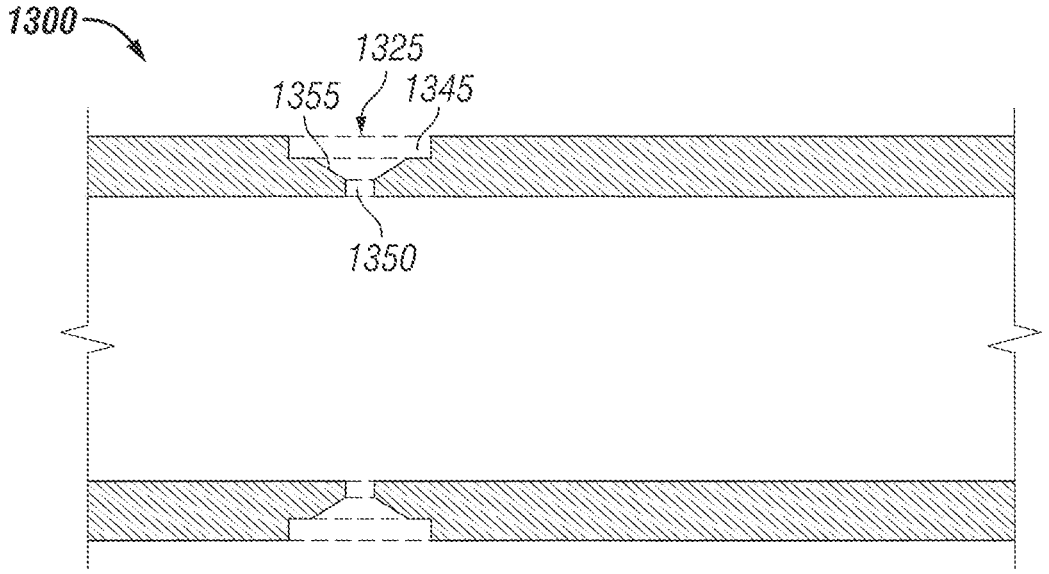
FIG. 13 is a side cross-sectional view of the base pipe for a sand control screen assembly, according to an embodiment of the present invention.

FIG. 13 illustrates an exemplary embodiment of a base pipe 1300 for a sand control screen assembly for use in a wellbore. Along with the other base pipes described in the present application, the base pipe 1300 may replace the base pipe 205 of the sand control screen assembly 200 described in FIGS. 2A-2D and may otherwise be used in the exemplary wellbore system 100 (FIG. 1) depicted therein. The base pipe 1300 is the same as that described above with regard to base pipe 205, except as specifically stated below. For the sake of brevity, the similarities will not be repeated herein below.

The base pipe 1300 includes one or more openings 1325 having an outer or top portion 1345, a chamfered middle portion 1355, and an inner or bottom portion 1350. The top portion 1345 may be larger in size than the middle portion 1355, and the middle portion 1355 may be larger in size than the bottom portion 1350 in a perspective top planar view. In the present embodiment, the openings 1325 are hybrid counterbore-countersunk holes.

Figure 14:
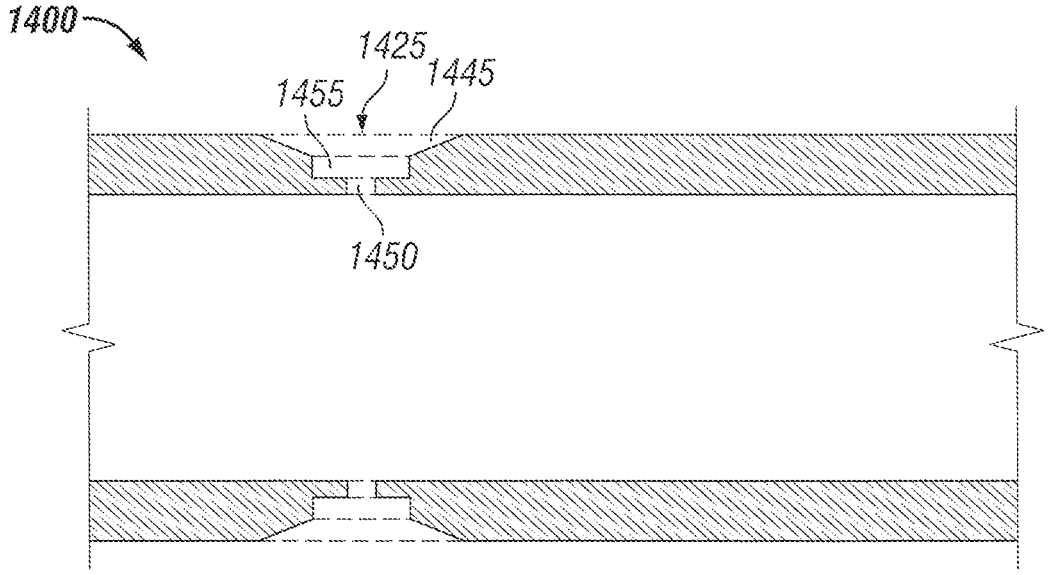
FIG. 14 is a side cross-sectional view of the base pipe for a sand control screen assembly, according to an embodiment of the present invention.

FIG. 14 illustrates an exemplary embodiment of a base pipe 1400 for a sand control screen assembly for use in a wellbore. Along with the other base pipes described in the present application, the base pipe 1400 may replace the base pipe 205 of the sand control screen assembly 200 described in FIGS. 2A-2D and may otherwise be used in the exemplary wellbore system 100 (FIG. 1) depicted therein. The base pipe 1400 is the same as that described above with regard to base pipe 205, except as specifically stated below. For the sake of brevity, the similarities will not be repeated herein below. The base pipe 1400 includes one or more openings 1425 having a beveled outer or top portion 1445, a middle portion 1455, and an inner or bottom portion 1450. The top portion 1445 may be larger in size than the middle portion 1455, and the middle portion 1455 may be larger in size than the bottom portion 1450 in a perspective top planar view. In the present embodiment, the openings 1425 are hybrid counterbore-countersunk holes.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sand control screen assembly, comprising:

a base pipe having a plurality of first openings through a thickness of the base pipe, wherein at least one of the plurality of first openings is characterized by a non-uniform cross-section, wherein each first opening of the plurality of first openings comprises a first portion and a second portion adjacent to the first portion, wherein the first portion is disposed adjacent to an inner surface of the base pipe, wherein the second portion is disposed adjacent to an outer surface of the base pipe, wherein the second portion comprises a plurality of channels, wherein each channel of the plurality of channels extends outward and upward relative to the first portion, wherein each channel of the plurality of channels comprises at least one side wall and at least one base wall, wherein the base wall is planar, wherein the first portion of each of the plurality of first openings is defined by a first outer surface, wherein the first outer surface and the at least one base wall of each channel of the plurality of channels are antiparallel with respect to each other.

2. The sand control screen assembly of claim 1, wherein the first portion has a first width that is less than a second width of the second portion.

3. The sand control screen assembly of claim 1, wherein the first portion has a first height that is greater than a second height of the second portion.

4. The sand control screen assembly of claim 1, further comprising one of a drainage layer or a filter medium positioned about the base pipe, wherein a plurality of spacer ribs are positioned between the base pipe and the drainage layer or filter medium, wherein the plurality of spacer ribs form a plurality of rib channels, and wherein the second portion spans at least two proximate rib channels of the plurality of rib channels to allow flow communication between the at least two proximate rib channels.

5. The sand control screen assembly of claim 1, wherein the base wall of each channel of each first opening terminates at the outer surface of the base pipe.

6. The sand control screen assembly of claim 1, further comprising a drainage layer positioned about the base pipe.

7. The sand control assembly of claim 6, further comprising inserts positioned in one or more of the first openings so as to provide a radial offset between the base pipe and the drainage layer.

8. The sand control screen assembly of claim 1, further comprising a filter medium positioned about the base pipe.

9. The sand control assembly of claim 8, further comprising inserts positioned in one or more of the first openings so as to provide a radial offset between the base pipe and the filter medium.

10. The sand control screen assembly of claim 8, further comprising a protective shroud positioned about the filter medium.

11. The sand control screen assembly of claim 1, wherein at least one of the first openings is countersunk.

12. The sand control screen assembly of claim 1, wherein at least one of the first openings is counterbored.

13. The sand control screen assembly of claim 1, wherein the plurality of channels of the second portion of each first opening are discontinuous with respect to each other.

14. The sand control screen assembly of claim 13, wherein the plurality of channels of the second portion of each first opening are symmetrically distributed about the first portion with respect to each other.

15. The sand control screen assembly of claim 1, wherein adjacent channels of the plurality of channels are separated from each other by a gap.

16. The sand control screen assembly of claim 1, wherein the base wall of each channel has a rectangular shape.

17. The sand control screen assembly of claim 1, wherein the base wall of each channel has a wedge shape.

18. The sand control screen assembly of claim 1, wherein the base pipe further has a plurality of second openings through the thickness of the base pipe, wherein at least one of the plurality of second openings is characterized by a uniform cross-section.

19. The sand control screen assembly of claim 1, wherein each of the at least one side wall is planar.

* * * * *